US007013909B2

(12) United States Patent
Shimizu et al.

(10) Patent No.: US 7,013,909 B2
(45) Date of Patent: Mar. 21, 2006

(54) VACUUM VALVE CONTROLLER

(75) Inventors: Osamu Shimizu, Tokyo (JP); Isamu Kamata, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/819,356

(22) Filed: Apr. 7, 2004

(65) Prior Publication Data

US 2004/0226606 A1 Nov. 18, 2004

(30) Foreign Application Priority Data

Apr. 10, 2003 (JP) ..... 2003-106863

(51) Int. Cl.
*B67C 3/16* (2006.01)

(52) U.S. Cl. ..... 137/205; 137/907

(58) Field of Classification Search ..... 137/205, 137/907

See application file for complete search history.

(56) References Cited

U.S. PATENT DOCUMENTS 4,373,838 A 2/1983 Foreman et al. ..... 406/14
5,588,458 A * 12/1996 Ushitora et al. ..... 137/205
5,871,027 A * 2/1999 Shimizu et al. ..... 137/205

FOREIGN PATENT DOCUMENTS

| | | |
|---|---|---|
| JP | 02-289730 | 11/1990 |
| JP | 10-60995 | 3/1998 |
| JP | 11-294625 | 10/1999 |

* cited by examiner

*Primary Examiner*—Kevin Lee
(74) *Attorney, Agent, or Firm*—Westerman, Hattori, Daniels & Adrian, LLP

(57) ABSTRACT

The present invention provides a vacuum valve controller for opening and closing a vacuum valve mounted on an end of a pipe of a vacuum system that is part of a vacuum sewage system. A vacuum valve controller includes a pressure sensor for converting a water level of sewage in a sewage pit into a pressure, a vacuum valve opening and closing mechanism for opening and closing the vacuum valve according to a variation of the pressure detected by the pressure sensor, an open-state holding mechanism for holding the vacuum valve open until air is drawn in through the suction pipe after sewage is drawn in through a suction pipe, and a pressure transmitting mechanism for transmitting a pressure upstream of the vacuum valve in the suction pipe to the open-state holding mechanism to detect when air is drawn in through the suction pipe.

14 Claims, 5 Drawing Sheets

VACUUM VALVE CONTROLLER

BACKGROUND OF THE INVENTION

1. Field of the Invention

The present invention relates to a vacuum valve controller for opening and closing a vacuum valve mounted on an end of a pipe of a vacuum system that is part of a vacuum sewage system.

2. Description of the Related Art

Heretofore, there has been known a vacuum sewage system which includes a vacuum system having a pipe connected to a sewage pit and delivers sewage stored in the sewage pit to a predetermined site such as a sewage treatment plant under a vacuum pressure developed in the pipe of the vacuum system. The vacuum sewage system has a sewage suction pipe placed in the sewage pit, a vacuum valve for selectively connecting the sewage suction pipe to and disconnecting the sewage suction pipe from the pipe of the vacuum system, and a vacuum valve controller for opening and closing the vacuum valve depending on the water level of sewage in the sewage pit.

FIG. 1 of the accompanying drawings is a sectional side view showing a sewage pit 300 and its associated components used in the conventional vacuum sewage system. As shown in FIG. 1, the sewage pit 300, which is placed in the ground, has a sewage tank 301 for holding sewage therein, a suction pipe 303 having a tip end disposed in the sewage tank 301, a vacuum valve 307 provided between the other end of the suction pipe 303 and a vacuum sewage pipe 305 of a vacuum system, a pressure sensor (pressure sensor pipe) 309 for converting a water level change in the sewage tank 301 into a pressure change, and a vacuum valve controller 311 for opening and closing the vacuum valve 307 depending on the pressure change detected by the pressure sensor 309. For example, the vacuum valve controller is disclosed in Japanese laid-open patent publication No. H2-289730. Further, a gravity flow-type sewage inlet pipe 313, and a breather pipe 315 for introducing the atmospheric pressure used by the vacuum valve controller 311 from the location above the ground which is not submerged are connected to the sewage pit 300.

When sewage flows from the sewage inlet pipe 313 into the sewage pit 300 and a certain amount of sewage is stored in the sewage tank 301, the pressure of the air in the pressure sensor 309 increases, and the pressure of the pressure sensor 309 is transmitted to the vacuum valve controller 311. When the pressure rise in the pressure sensor 309 reaches a predetermined level, the vacuum valve controller 311 supplies a negative pressure introduced from the vacuum sewage pipe 305 to the vacuum valve 307, thereby opening the vacuum valve 307, drawing the sewage in the sewage tank 301 through the suction pipe 303 into the vacuum sewage pipe 305, and draining the sewage. When the amount of sewage in the sewage tank 301 decreases as it is drained, the pressure in the pressure sensor 309 is lowered. When the pressure in the pressure sensor 309 which is lowered to a predetermined level or below is detected by the vacuum valve controller 311, the vacuum valve controller 311 switches the negative pressure supplied to the vacuum valve 307 to the atmospheric pressure, thereby closing the vacuum valve 307 to stop drawing the sewage in through the suction pipe 303.

Since the vacuum valve controller 311 opens and closes the vacuum valve 307 by utilizing the vacuum pressure of the vacuum sewage pipe 305, the opening time of the vacuum valve 307 depends on the degree of vacuum that is achieved in the vacuum sewage pipe 305 connected to the sewage pit 300. If the degree of vacuum in the vacuum sewage pipe 305 is low, then the opening time of the vacuum valve 307 is short, and hence the vacuum valve 307 may be closed after sucking in only sewage without sucking in air. As a result, water hammer is generated in the vacuum valve 307 to cause the vacuum valve 307 to drop out of the suction pipe 303, or to cause damage to the vacuum valve 307. Further, because air needed for delivering sewage does not flow in, an air lock tends to be developed in the pipe system, The air lock refers to a phenomenon in which sewage is accumulated at an upstream side of a lift (a short upgrade step provided to reduce a burial depth of the vacuum sewage pipe 305 after the vacuum sewage pipe 305 is laid linearly on a downgrade in the ground), and there is no vent hole portion. If the air lock is developed, then the degree of vacuum required to deliver sewage is not achieved at the end of the vacuum sewage pipe 305, making it difficult to deliver sewage.

A vacuum valve controller for solving the above problems is disclosed, for example, in Japanese patent application No. H8-244194 (Japanese laid-open patent publication No. 10-60995). The disclosed vacuum valve controller has two nozzles mounted on upstream and downstream points of the suction pipe 303 for detecting respective pressures in those upstream and downstream points. Based on the difference between the detected pressures, it is determined whether sewage is flowing through the suction pipe 303 or air is being drawn through the suction pipe 303. When the pressure of air in the pressure sensor 309 increases to a predetermined value, the vacuum valve controller 311 opens the vacuum valve 307 to suck sewage from the suction pipe 303. Thereafter, the vacuum valve controller 311 closes the vacuum valve 307 when there is no sewage in the suction pipe 303 and the start of drawing in air is detected. Since the pressure difference is constant regardless of the degree of vacuum that is achieved, the vacuum valve 307 is always closed after the vacuum valve 307 sucks in air. Therefore, no water hammer occurs, and an air lock is hardly developed in the pipe system.

However, if the existing vacuum valve controller 311 shown in FIG. 1 is to be replaced with the vacuum valve controller disclosed in Japanese patent application No. H8-244194 (Japanese laid-open patent publication No. 10-60995) for the purpose of solving the air lock or the like, then not only the vacuum valve controller 311 needs to be replaced, but also two nozzles are required to be installed on the upstream and downstream points of the suction pipe 303 for detecting respective pressures in those upstream and downstream points. This modification is highly laborsome and time-consuming. The suction pipe 303 may be replaced with a suction pipe combined with two nozzles. However, because such a suction pipe combined with two nozzles has a cross-sectional shape different from that of the existing suction pipe 303, a partition plate 316 which divides the sewage tank 301 and the area where the vacuum valve 307 and its associated components are installed from each other needs to be modified. Therefore, a large replacement expense is required.

SUMMARY OF THE INVENTION

It is therefore an object of the present invention to provide a vacuum valve controller which can be remodeled easily and inexpensively even when an existing vacuum valve controller is replaced with a vacuum valve controller having a structure which enables a vacuum valve to close after air is drawn in from a sewage pit.

According to a first aspect of the present invention, there is provided a vacuum valve controller for opening and closing a vacuum valve provided between a suction pipe having an end placed in a sewage pit and a vacuum system for delivering sewage from the sewage pit under vacuum, the vacuum valve controller comprising: a pressure sensor for converting a water level of sewage in the sewage pit into a pressure; a vacuum valve opening and closing mechanism for opening and closing the vacuum valve according to a variation of the pressure detected by the pressure sensor; an open-state holding mechanism for holding the vacuum valve open until air is drawn in through the suction pipe after sewage is drawn in through the suction pipe; and a pressure transmitting mechanism for transmitting a pressure upstream of the vacuum valve in the suction pipe to the open-state holding mechanism to detect when air is drawn in through the suction pipe.

According to a preferred aspect of the present invention, the vacuum valve controller further comprises a transmitting path for transmitting the pressure upstream of the vacuum valve in the suction pipe to the open-state holding mechanism; and a restriction mechanism disposed in the transmitting path for restricting an amount of air flowing therethrough.

According to a preferred aspect of the present invention, the vacuum valve controller further comprises a transmitting path for transmitting the pressure upstream of the vacuum valve in the suction pipe to the open-state holding mechanism; and a pressure, regulating mechanism for introducing external air to regulate the pressure in the transmitting path.

According to a preferred aspect of the present invention, the vacuum valve controller further comprises a restriction mechanism disposed in the transmitting path for restricting an amount of air flowing therethrough.

According to a preferred aspect of the present invention, the vacuum valve opening and closing mechanism comprises; a shaft movable to operate the vacuum valve opening and closing mechanism; an urging device for normally urging the shaft in a first direction; a first diaphragm for moving the shaft; and a first chamber formed on one side of the first diaphragm, the pressure converted by the pressure sensor being introduced into the first chamber, wherein the open-state holding mechanism comprises: a second diaphragm for moving the shaft; a second chamber formed on one side of the second diaphragm, the second chamber having an atmospheric pressure; and a third chamber formed on the other side of the second diaphragm, wherein a deferential pressure between pressures in the second chamber and the third chamber is applied to the shaft to move the shaft in a second direction against an urging force of the urging device.

According to a preferred aspect of the present invention, the urging device comprises a spring.

According to a preferred aspect of the present invention, the shaft is configured to supply a first pressure into a piston chamber of the vacuum valve to close the vacuum valve when the shaft is moved in the first direction, wherein the shaft is configured to supply a second pressure into the piston chamber to open the vacuum valve when the shaft is moved in the second direction.

According to a preferred aspect of the present invention, the first pressure is the atmospheric pressure.

According to a preferred aspect of the present invention, the second pressure is a pressure lower than the atmospheric pressure.

According to a second aspect of the present invention, there is provided a vacuum valve system comprising: a vacuum valve provided between a suction pipe having an end placed in a sewage pit and a vacuum system for delivering sewage from the sewage pit under vacuum; a pressure sensor for converting a water level of sewage in the sewage pit into a pressure; a vacuum valve opening and closing mechanism for opening and closing the vacuum valve according to a variation of the pressure detected by the pressure sensor; an open-state holding mechanism for holding the vacuum valve open until air is drawn in through the suction pipe after sewage is drawn in through the suction pipe; and a pressure transmitting mechanism for transmitting a pressure upstream of the vacuum valve in the suction pipe to the open-state holding mechanism to detect when air is drawn in through the suction pipe.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENTS

A vacuum valve controller according to embodiments of the present invention will be described in detail with reference to the drawings.

Figure 2:
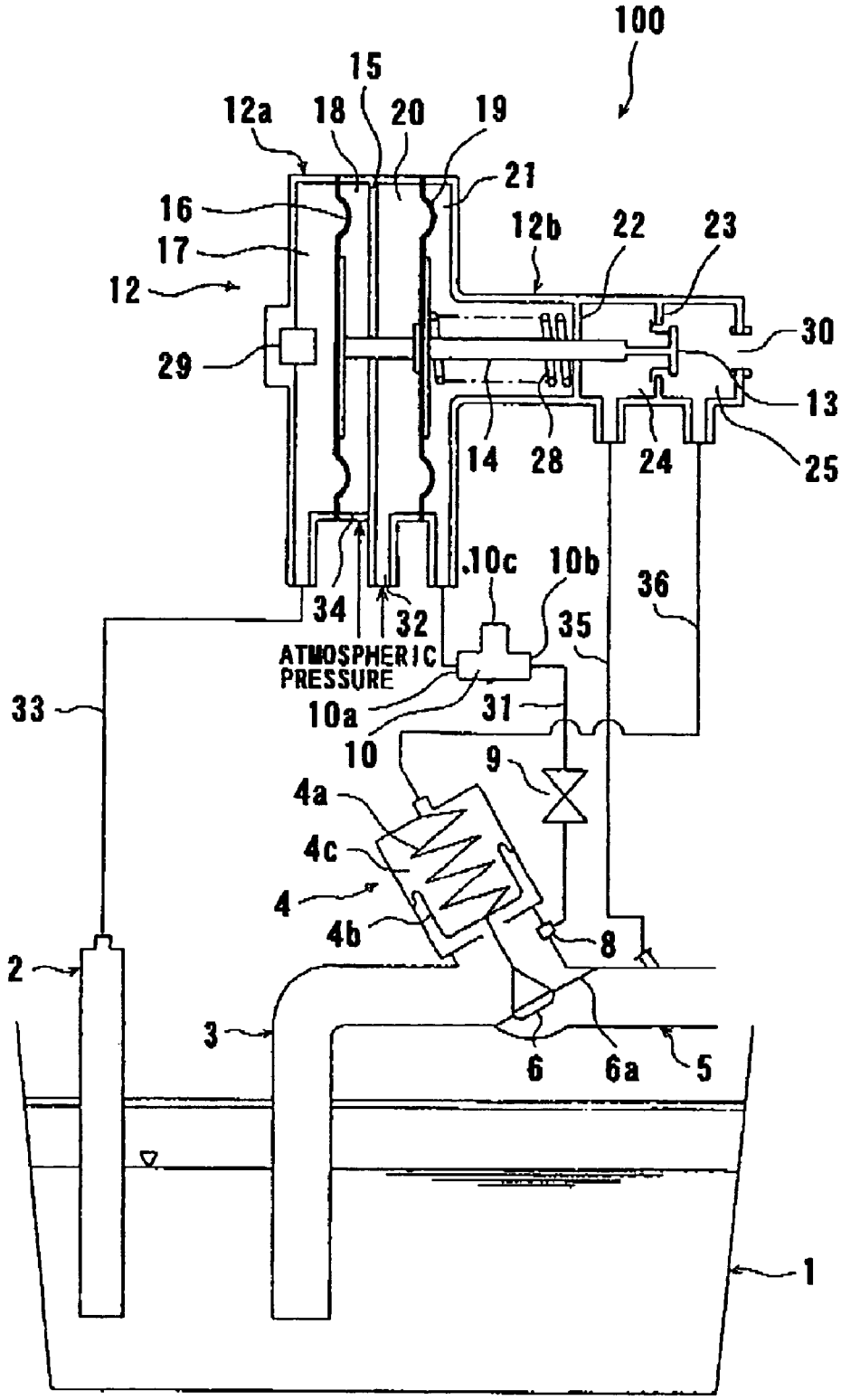
FIG. 2 is a schematic sectional side view of a vacuum valve controller attached to a vacuum valve according to an embodiment of the present invention.
Figure 3:
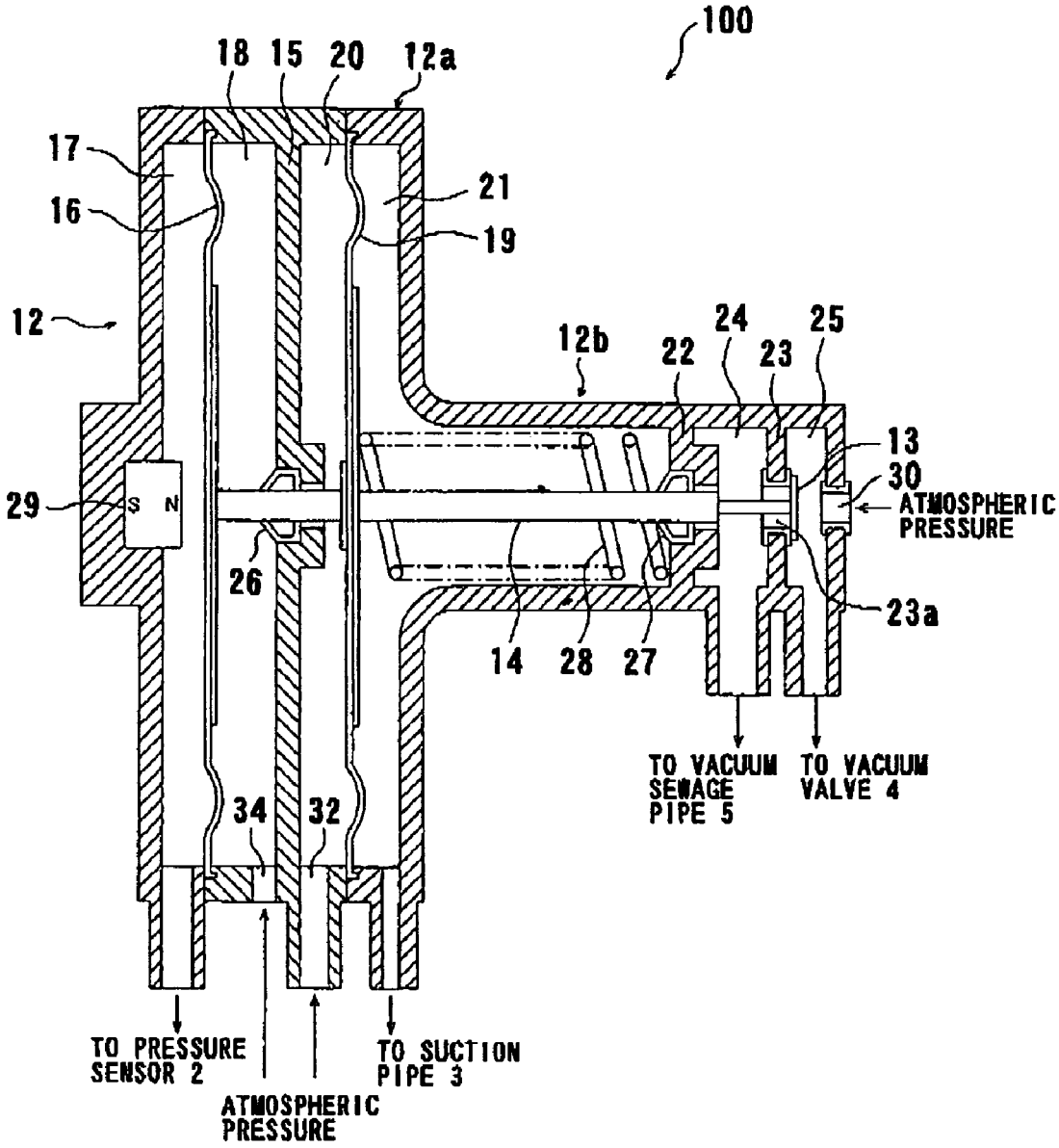
FIG. 3 is an enlarged cross-sectional view of the vacuum valve controller shown in FIG. 2.

FIG. 2 is a sectional side view of a vacuum valve controller 100 attached to a vacuum valve 4 according to the present invention. FIG. 3 is an enlarged cross-sectional view of the vacuum valve controller 100. As shown in FIGS. 2 and 3, a suction pipe 3 has a distal end inserted in a sewage pit 1 and an opposite end connected through a vacuum valve 4 to a vacuum sewage pipe 5 (vacuum system) communicating with a vacuum tank (not shown). The vacuum valve 4 is controlled so as to be opened and closed by the vacuum valve controller 100.

The vacuum valve 4 comprises a piston chamber 4*c*, a diaphragm 4*b* disposed in the piston chamber 4*c*, a spring 4*a* disposed in the piston chamber 4*c* for biasing the diaphragm 4*b*, and a valve disc (valve element) 6 disposed outside of the piston chamber 4*c* and being movable for opening and closing the vacuum valve 4 in response to a change in air pressure in the piston chamber 4*c*. When the air pressure supplied from the vacuum valve controller 100 to the piston chamber 4*c* of the vacuum valve 4 is lower than a predetermined pressure which is lower than the atmospheric pressure by a certain value, then the diaphragm 4*b* is displaced against the bias of the spring 4*a* to lift the valve disc 6 off a valve seat 6*a*, thus opening the vacuum valve 4.

When the air pressure supplied from the vacuum valve controller 100 to the piston chamber 4*c* of the vacuum valve 4 is equal to the atmospheric pressure, the valve disc 6 is seated on the valve seat 6*a* under the resiliency of the spring 4*a*, thus closing the vacuum valve 4.

As shown in FIG. 3, the vacuum valve controller 100 has a unitary casing 12 including a larger-diameter portion 12*a* and a smaller-diameter portion 12*b*. The larger-diameter portion 12*a* has a partition wall 15 disposed centrally therein, and a shaft 14 of a valve disc 13 extends through the partition wall 15. The partition wall 15 divides the interior space in the larger-diameter portion 12*a* into right and left compartments. The left compartment is further divided into a first chamber 17 and a second chamber 18 by a first diaphragm (sensor diaphragm) 16 that is disposed centrally in the left compartment. The right compartment is further divided into a third chamber 20 and a fourth chamber 21 by a second diaphragm 19 that is disposed centrally in the right compartment. The smaller-diameter portion 12*b* has a partition wall 22 disposed substantially centrally therein, and the interior space in the smaller-portion 12*b* is divided into right and left compartments by the partition wall 22. The left compartment of the smaller-diameter portion 12*b* is held in communication with the fourth chamber 21, and the right compartment of the smaller-diameter portion 12*b* is further divided into a fifth chamber 24 and a sixth chamber 25 by a partition wall 23.

The valve disc 13 fixed to the tip end of the shaft 14 is positioned in the sixth chamber 25. The rear end of the shaft 14 is brought into contact with a central region of the first diaphragm 16. The rear end of the shaft 14 and the central region of the first diaphragm 16 are merely brought in contact with each other, but are discrete from each other. Therefore, when the first diaphragm 16 (which is of a magnetic material) is displaced to the right direction, the first diaphragm 16 exerts a rightward force on the shaft 14. However, when the first diaphragm 16 is displaced to the left direction, the first diaphragm 16 exerts no forces on the shaft 14. The shaft 14 extends through the partition wall 15, and also extends through the second diaphragm 19 which is fixed to the shaft 14. Further, the shaft 14 extends through the partition wall 22 and the partition wall 23. A seal mechanism 26 is disposed around the portion of the shaft 14 which passes through the partition wall 15, and a seal mechanism 27 is disposed around the portion of the shaft 14 which passes through the partition wall 22. The partition wall 23 has a through hole 23*a* defined therein, and the shaft 14 passes through the through hole 23*a*. The through hole 23*a* can be opened and closed by the valve disc 13. The second diaphragm 19 is normally urged to the left by a spring 28 disposed between the second diaphragm 19 and the partition wall 22.

A magnet 29 is mounted on a wall of the casing 12 so as to face the end of the shaft 14. The first chamber 17 is held in communication with a pressure sensor pipe (pressure sensor) 2 through a pipe 33. The second chamber 18 and the third chamber 20 are vented to the atmosphere through respective holes 34, 32. The fourth chamber 21 is connected by a pipe 31 to a nozzle 8 mounted on a portion of the vacuum valve 4 which is connected between the vacuum sewage pipe 5 and the suction pipe 3. The nozzle 8 serves as a pressure transmitting mechanism for detecting or picking up the pressure in the region, which can be opened and closed by the valve disc 6, between the vacuum sewage pipe 5 and the suction pipe 3. A restriction mechanism 9 and a pressure regulating mechanism 10 connected in series to each other are provided in the pipe 31. The pressure regulating mechanism 10 has three ports 10*a*, 10*b* and 10*c*, and the two ports 10*a*, 10*b* are connected to the pipe 31 and the port 10*c* communicates with the atmosphere. When the vacuum valve 4 is closed, the pressure in the fourth chamber 21 is atmospheric pressure because the pressure regulating mechanism 10 is vented to the atmosphere. At this time, the fourth chamber 21 has the same pressure as the third chamber 20. The fifth chamber 24 is held in communication with the vacuum sewage pipe 5 by a pipe 35. The sixth chamber 25 has a hole 30 which can be opened and closed by the valve disc 13 and can communicate with the atmosphere. Further, the sixth chamber 25 is held in communication with the piston chamber 4*c* of the vacuum chamber 4 by a pipe 36.

The vacuum valve controller 100 thus constructed operates as follows: When the water level of sewage in the sewage pit 1 increases and the pressure in the pressure sensor pipe 2 increases, the pressure is transmitted via the pipe 33 to the first chamber 17 of the vacuum valve controller 100. The first diaphragm 16 is displaced to the right against the resilient force of the spring 28 and the magnetic attraction force of the magnet 29, thus pushing the shaft 14 to cause the valve disc 13 to close the hole 30 that communicates with the atmosphere. A negative pressure is transmitted from the vacuum sewage pipe 5 via the pipe 35 to the fifth chamber 24 and the sixth chamber 25, and then the negative pressure is transmitted to the piston chamber 4*c* of the vacuum valve 4, thus lifting the valve disc 6 off the valve seat 6*a* to cause the vacuum valve 4 to be opened. At this time, the first diaphragm 16 is pushed by the pressure from the pressure sensor pipe 2 to move the shaft 14 to the right, and hence the resilient force of the spring 28 increases and the magnetic attraction force of the magnet 29 sharply drops (being inversely proportion to the square of the moving distance of the shaft 14). Consequently, the shaft 14 is quickly moved to its stroke end, i.e., to a position in which the valve disc 13 closes the hole 30, thus switching the vacuum valve controller 100 into operating condition. The fifth chamber 24, the sixth chamber 25, and the valve disc 13 jointly serve as a vacuum valve opening and closing control mechanism for opening and closing the vacuum valve 4.

Figure 4:
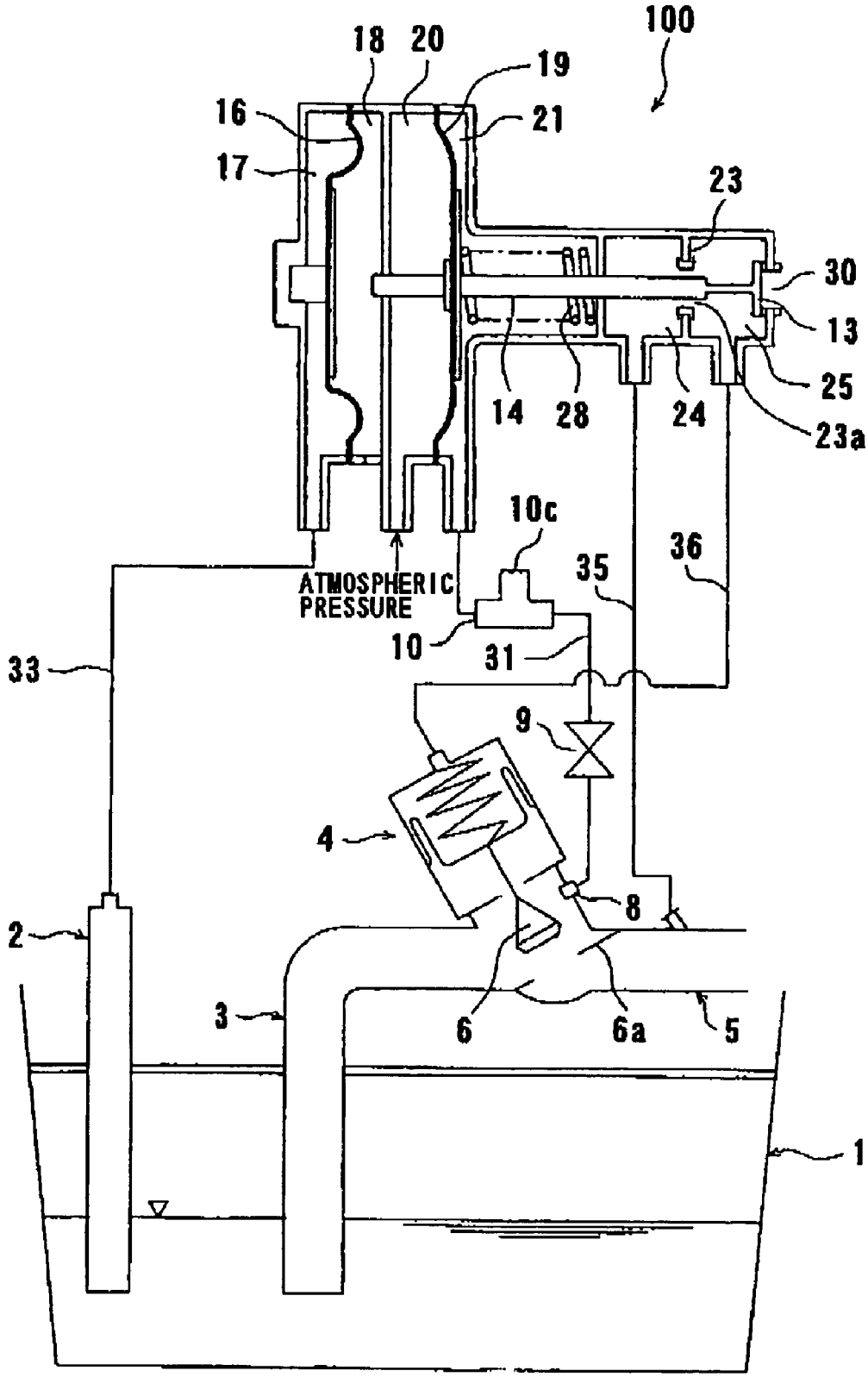
FIG. 4 is a schematic sectional side view showing the manner in which the vacuum valve controller shown in FIG. 2 operates.

When the valve disc 6 is lifted off the valve seat 6*a*, the vacuum sewage pipe 5 and the suction pipe 3 communicate with each other, thus starting to draw in sewage from the suction pipe 3. Since the valve disc 6 is lifted, the negative pressure from the vacuum sewage pipe 5 is introduced into the space near the valve disc 6 (upstream of the valve seat 6*a*), thus drawing in air from the port 10*c* of the pressure regulating mechanism 10, which communicates with the atmosphere, through the pipe 31 and the nozzle B into the vacuum sewage pipe 5, and also drawing in air from the fourth chamber 21 into the vacuum sewage pipe 5. Thus, a negative pressure is developed in the fourth chamber 21. Now, a differential pressure is developed between the third chamber 20 which is under the atmospheric pressure and the fourth chamber 21, thus pushing the second diaphragm 19 to the right. Therefore, the valve disc 13 is further pushed to the right by the shaft 14. Even when the water level of sewage in the sewage pit 1 is lowered to eliminate the pressure difference between the first chamber 17 and the second chamber 18, and then the first diaphragm 16 moves to the left as shown in FIG. 4, the negative pressure from the vacuum sewage pipe 5 reaches the nozzle 8 as long as sewage is flowing through the suction pipe 3. As a result, the valve disc 13 remains pushed to the right under the differential pressure between the third chamber 20 and the fourth chamber 21. Thus, the vacuum valve controller 100 is kept in operation. The second diaphragm 19, the third chamber 20, and the fourth chamber 21 jointly serve as an open-state holding mechanism.

When the water level of sewage in the sewage pit 1 is further lowered and the vacuum valve 4 starts drawing in air, the pressure near the nozzle 8 becomes nearly atmospheric pressure. Therefore, the atmospheric pressure drawn in from the port 10*c* of the pressure, regulating mechanism 10 is introduced into the fourth chamber 21. As a result, the force produced by the differential pressure between the third chamber 20 and the fourth chamber 21 becomes smaller than the resilient force of the spring 28, and hence the shaft 14 is displaced to the left under the resilient force of the spring 28, thus causing the valve disc 13 to close the through hole 23*a* in the partition wall 23. The vacuum valve controller 100 is now switched into standby condition. The atmospheric air flows into the sixth chamber 25 from the hole 30, and then flows via the pipe 36 into the piston chamber 4*c* of the vacuum valve 4. The valve disc 6 is pushed out under the resilient force of the spring 4*a* and is seated on the valve seat 6*a*, thus closing the vacuum valve 4. The suction pipe 3 and the vacuum sewage pipe 5 are now brought out of communication with each other. Since the vacuum valve 4 is closed after it has drawn in air regardless of the degree of vacuum that is reached, water hammer hardly occurs and air lock is hardly developed in the vacuum sewage pipe 5.

As described above, since the vacuum valve 4 draws in air from the port 10*c* of the pressure regulating mechanism 10 while sewage is being drawn from the sewage pit 1, the vacuum valve 4 operates in a combined manner where the vacuum valve 4 simultaneously draws in sewage and air and thereafter draws in only air for a certain period of time, thus contributing to elimination of an air lock in the pipe system.

According to the present embodiment, the restriction mechanism 9 is capable of regulating the amount of air drawn from the suction pipe 3 into the vacuum valve 4 depending on the degree of vacuum that reaches the vacuum valve 4 on the site. Specifically, if the restriction opening of the restriction mechanism 9 is reduced, then when the vacuum valve 4 is opened and draws in sewage from the sewage pit 1, the degree of vacuum at the side of the vacuum valve 4 is made more difficult to reach the fourth chamber 21. Thus, the fourth chamber 21 tends to be supplied more quickly with the atmospheric pressure from the port 10*c* of the pressure regulating mechanism 10. Accordingly, the differential pressure between the fourth chamber 21 and the third chamber 20 is reduced to close the vacuum valve 4 more quickly, thereby reducing the amount of air that is drawn from the suction pipe 3 into the vacuum valve 4. Conversely, if the restriction opening of the restriction mechanism 9 is enlarged, then when the vacuum valve 4 is opened and draws in sewage from the sewage pit 1, the degree of vacuum at the side of the vacuum valve 4 is made easier to reach the fourth chamber 21. Thus, the differential pressure between the fourth chamber 21 and the third chamber 20 tends to be 5 maintained. Accordingly, the vacuum valve 4 remains open for a longer period of time, and hence the amount of air that is drawn from the suction pipe 3 into the vacuum valve 4 can be increased.

The port 10*c* of the pressure regulating mechanism 10 may comprise only an open hole without a restriction adjusting mechanism. This open hole may be combined with a suction air control valve. Such a suction air control valve is of a structure for drawing in more air when the degree of vacuum in the vacuum valve 4 is higher, and drawing in less air when the degree of vacuum in the vacuum valve 4 is lower.

Figure 5:
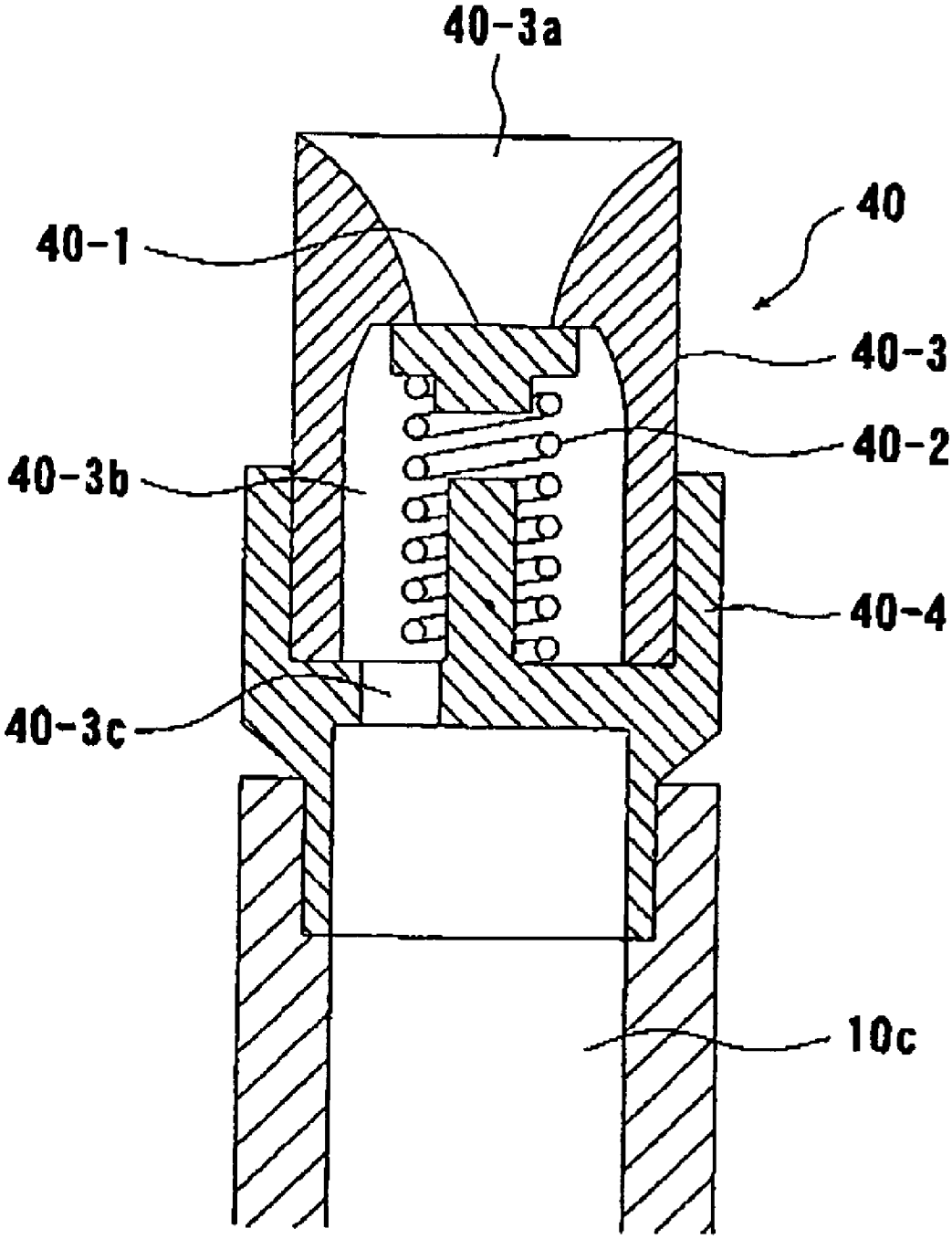
FIG. 5 is an enlarged cross-sectional view of an example of a suction air control valve.

FIG. 5 is a schematic cross-sectional view showing an example of a suction air control valve 40. As shown in FIG. 5, the suction air control valve 40 has a tubular valve body holder 40-4 mounted in the port 10*c* of the pressure regulating mechanism 10, a valve body 40-3 mounted in the valve body holder 40-4 and having a rubber sheet chamber 40-3*b* defined therein, and a rubber sheet 40-1 and a spring 40-2 which are housed in the rubber sheet chamber 40-3*b*. The valve body 40-3 has an opening 40-3*a* defined in an upper portion thereof above the rubber sheet chamber 40-3*b*. The valve body holder 40-4 has a vent hole 40-3*c* that communicates with the rubber sheet chamber 40-3*b*. The opening 40-3*a* is normally held out of communication with the rubber sheet chamber 40-3*b* by the rubber sheet 40-1 under the resilient force of the spring 40-2. The tubular valve body holder 40-4 has a lower end screwed into the port 10*c*.

The suction air control valve 40 operates as follows: Since the rubber sheet 40-1 closes the opening 40-3*a* under the resilient force of the spring 40-2, the suction air control valve 40 is normally closed. When the vacuum valve 4 shown in FIG. 2 is opened and the degree of vacuum in the pressure regulating mechanism 10 rises to a predetermined value or more, the force produced by the pressure difference between the atmospheric pressure acting on the rubber sheet 40-1 through the opening 40-3*a* and the negative pressure in the pressure regulating mechanism 10 becomes larger than the resilient force of the spring 40-2, thus lowering the rubber sheet 40-1 to draw air from the opening 40-3*a* into the pressure regulating mechanism 10. The amount of air drawn into the pressure regulating mechanism 10 increases because the higher the degree of vacuum in the pressure regulating mechanism 10 is, the larger the lowering distance of the rubber sheet 40-1 is. When the degree of vacuum in the pressure regulating mechanism 10 becomes the predetermined value or less the rubber sheet 40-1 is lifted under the resilient force of the spring 40-2, thus closing the opening 40-3*a*. Therefore, air is prevented from flowing into the pressure regulating mechanism 10.

With the suction air control valve 40 mounted in the port 10*c* of the pressure regulating mechanism 10, when the vacuum valve 4 is opened, if the degree of vacuum that reaches the pressure regulating mechanism 10 from the vacuum valve 4 is higher, then more air is drawn in from the port 10*c*, thus lowering the degree of vacuum in the fourth chamber 21 under the negative pressure from the vacuum valve 4. If the degree of vacuum that reaches the pressure regulating mechanism 10 from the vacuum valve 4 is lower, then less air is drawn in from the port 10*c*, and the degree of vacuum in the fourth chamber 21 is not significantly lowered. As a result, the degree of vacuum in the fourth chamber 21 is kept substantially constant, so that the pressure difference between the fourth chamber 21 and the third chamber 20 remains constant.

Figure 1:
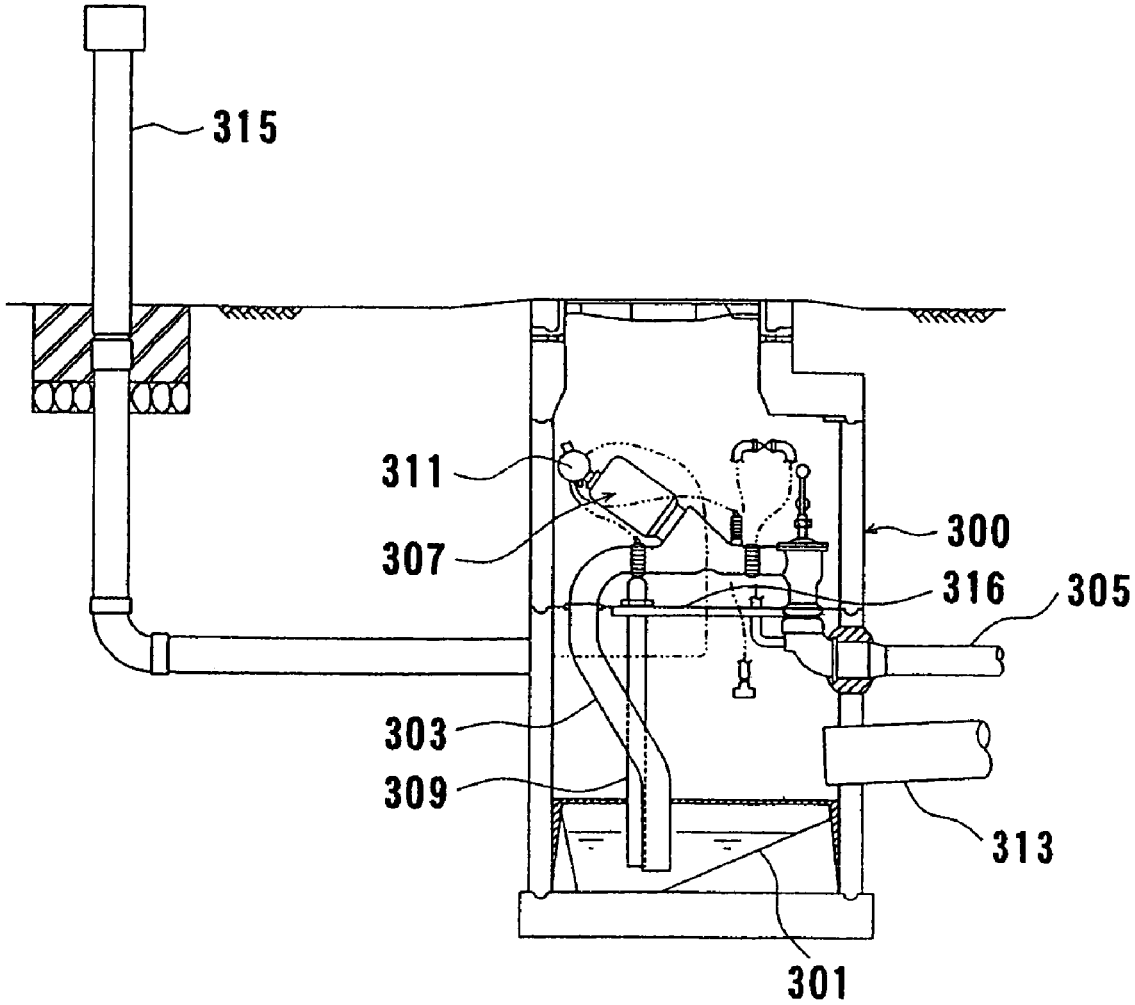
PRIOR ART FIG. 1
FIG. 1 is a schematic sectional side view showing a sewage pit and its associated components used in a conventional vacuum sewage system.

The vacuum valve controller 100 operates even when it is placed underwater. Basically, however, the vacuum valve controller 100 should preferably be installed above the sewage stored in the sewage pit 1 (300). The port 10*c* of the pressure regulating mechanism 10 may be connected to the breather pipe 315 shown in FIG. 1, which is not submerged, for drawing in the atmospheric pressure.

In the above embodiment, the nozzle a is used as the pressure transmitting mechanism for detecting or picking up the pressure near the vacuum valve 4. However, the pressure transmitting mechanism may be composed of any other various structures such as enables the pipe 31 to be directly connected to the region which is opened and closed by the valve disc 6 of the vacuum valve 4, without using the nozzle 8. In short, any structure will be employed insofar as the pressure transmitting mechanism is capable of detecting the pressure in the region which is opened and closed by the valve disc (valve element) of the vacuum valve.

As described above, the present invention offers the following excellent advantages:

(1) Drawing of air after sewage is drawn in is detected by picking up the pressure in the region, which is opened and closed by the valve disc of the vacuum valve, with the pressure transmitting mechanism, and transmitting the pressure picked up by the pressure transmitting mechanism to the open-state holding mechanism. Since the open-state holding mechanism is provided, a process of replacing any existing vacuum valve controller with the vacuum valve controller which is of such a structure that allows the vacuum valve to be closed after the vacuum valve draws in air, can be performed simply by replacing the vacuum valve controller and installing the pressure transmitting mechanism on the vacuum valve. The modification is relatively easy and inexpensive because the suction pipe does not need to be modified or replaced with a new one and no partition needs to be modified.

(2) Because the restriction mechanism is provided in the path for transmitting the pressure picked up by the pressure transmitting mechanism to the open-state holding mechanism, the amount of air drawn from the suction pipe into the vacuum valve can be adjusted by the restriction mechanism depending on the degree of vacuum that reaches the vacuum valve at the site.

(3) Because the pressure regulating mechanism is provided in the path for transmitting the pressure picked up by the pressure transmitting mechanism to the open-state holding mechanism, the pressure in the transmitting path can be regulated for allowing the vacuum valve to operate stably irrespective of various degree of vacuum that reaches the vacuum valve. External air introduced from the pressure regulating mechanism is supplied to the vacuum valve while sewage is being drawn from the sewage pit. Consequently, the vacuum valve can be operated in the combined manner for effectively eliminating an air lock in the vacuum sewage pipe.

Although a certain preferred embodiment of the present invention has been shown and described in detail, it should be understood that various changes and modifications may be made therein without departing from the scope of the appended claims.

What is claimed is:

1. A vacuum valve controller for opening and closing a vacuum valve provided between a suction pipe having an end placed in a sewage pit and a vacuum system for delivering sewage from the sewage pit under vacuum, said vacuum valve controller comprising:

a pressure sensor for converting a water level of sewage in the sewage pit into a pressure;

a vacuum valve opening and closing mechanism for opening and closing the vacuum valve according to a variation of the pressure detected by said pressure sensor;

an open-state holding mechanism for holding the vacuum valve open until air is drawn in through the suction pipe after sewage is drawn in through the suction pipe;

a pressure transmitting mechanism for transmitting a pressure upstream of the vacuum valve in the suction pipe to said open-state holding mechanism to detect when air is drawn in through the suction pipe;

a transmitting path for transmitting the pressure upstream of the vacuum valve in the suction pipe to said open-state holding mechanism; and a pressure regulating mechanism for introducing external air to regulate the pressure in said transmitting path.

2. The vacuum valve controller as recited in claim 1, further comprising a restriction mechanism disposed in said transmitting path for restricting an amount of air flowing therethrough.

3. A vacuum valve controller for opening and closing a vacuum valve provided between a suction pipe having an end placed in a sewage pit and a vacuum system for delivering sewage from the sewage pit under vacuum, said vacuum valve controller comprising:

a pressure sensor for converting a water level of sewage in the sewage pit into a pressure;

a vacuum valve opening and closing mechanism for opening and closing the vacuum valve according to a variation of the pressure detected by said pressure sensor;

an open-state holding mechanism for holding the vacuum valve open until air is drawn in through the suction pipe after sewage is drawn in through the suction pipe; and a pressure transmitting mechanism for transmitting a pressure upstream of the vacuum valve in the suction pipe to said open-state holding mechanism to detect when air is drawn in through the suction pipe, wherein said vacuum valve opening and closing mechanism comprises:

a shaft movable to operate said vacuum valve opening and closing mechanism;

an urging device for normally urging said shaft in a first direction;

a first diaphragm for moving said shaft; and a first chamber formed on one side of said first diaphragm, the pressure converted by said pressure sensor being introduced into said first chamber, wherein said open-state holding mechanism comprises:

a second diaphragm for moving said shaft;

a second chamber formed on one side of said second diaphragm, said second chamber having an atmospheric pressure; and a third chamber formed on the other side of said second diaphragm, and wherein a deferential pressure between pressures in said second chamber and said third chamber is applied to said shaft to move said shaft in a second direction against an urging force of said urging device.

4. The vacuum valve controller as recited in claim 3, wherein said urging device comprises a spring.

5. The vacuum valve controller as recited in claim 3, wherein said shaft is configured to supply a first pressure into a piston chamber of the vacuum valve to close the vacuum valve when said shaft is moved in the first direction, wherein said shaft is configured to supply a second pressure into the piston chamber to open the vacuum valve when said shaft is moved in the second direction.

6. The vacuum valve controller as recited in claim 5, wherein the first pressure is the atmospheric pressure.

7. The vacuum valve controller as recited in claim 5, wherein the second pressure is a pressure lower than the atmospheric pressure.

8. A vacuum valve system comprising:

a vacuum valve provided between a suction pipe having an end placed in a sewage pit and a vacuum system for delivering sewage from the sewage pit under vacuum;

a pressure sensor for converting a water level of sewage in the sewage pit into a pressure;

a vacuum valve opening and closing mechanism for opening and closing said vacuum valve according to a variation of the pressure detected by said pressure sensor;

an open-state holding mechanism for holding said vacuum valve open until air is drawn in through the suction pipe after sewage is drawn in through the suction pipe; and a pressure transmitting mechanism for transmitting a pressure upstream of said vacuum valve in the suction pipe to said open-state holding mechanism to detect when air is drawn in through the suction pipe;

a transmitting path for transmitting the pressure upstream of said vacuum valve in the suction pipe to said open-state holding mechanism; and a pressure regulating mechanism for introducing external air to regulate the pressure in said transmitting path.

9. The vacuum valve system as recited in claim 8, further comprising a restriction mechanism disposed in said transmitting path for restricting an amount of air flowing therethrough.

10. A vacuum valve system comprising:

a vacuum valve provided between a suction pipe having an end placed in a sewage pit and a vacuum system for delivering sewage from the sewage pit under vacuum;

a pressure sensor for converting a water level of sewage in the sewage pit into a pressure;

a vacuum valve opening and closing mechanism for opening and closing said vacuum valve according to a variation of the pressure detected by said pressure sensor;

an open-state holding mechanism for holding said vacuum valve open until air is drawn in through the suction pipe after sewage is drawn in through the suction pipe; and a pressure transmitting mechanism for transmitting a pressure upstream of said vacuum valve in the suction pipe to said open-state holding mechanism to detect when air is drawn in through the suction pipe;

wherein said vacuum valve opening and closing mechanism comprises:

a shaft movable to operate said vacuum valve opening and closing mechanism;

an urging device for normally urging said shaft in a first direction;

a first diaphragm for moving said shaft; and a first chamber formed on one side of said first diaphragm, the pressure converted by said pressure sensor being introduced into said first chamber, wherein said open-state holding mechanism comprises:

a second diaphragm for moving said shaft;

a second chamber formed on one side of said second diaphragm, said second chamber having an atmospheric pressure; and a third chamber formed on the other side of said second diaphragm, and wherein a deferential pressure between pressures in said second chamber and said third chamber is applied to said shaft to move said shaft in a second direction against an urging force of said urging device.

11. The vacuum valve system as recited in claim 10, wherein said urging device comprises a spring.

12. The vacuum valve system as recited in claim 10, further comprising a piston chamber for opening and closing said vacuum valve by a pressure applied to said piston chamber, wherein said shaft is configured to supply a first pressure into said piston chamber to close said vacuum valve when said shaft is moved in the first direction, wherein said shaft is configured to supply a second pressure into said piston chamber to open said vacuum valve when said shaft is moved in the second direction.

13. The vacuum valve system as recited in claim 12, wherein the first pressure is the atmospheric pressure.

14. The vacuum valve system as recited in claim 12, wherein the second pressure is a pressure lower than the atmospheric pressure.

* * * * *